United States Patent [19]

Bernstrom

[11] Patent Number: 4,715,798

[45] Date of Patent: Dec. 29, 1987

[54] TWO-SPEED VALVE-IN STAR MOTOR

[75] Inventor: Marvin L. Bernstrom, Eden Prairie, Minn.

[73] Assignee: Eaton Corporation, Cleveland, Ohio

[21] Appl. No.: 7,882

[22] Filed: Jan. 28, 1986

Related U.S. Application Data

[63] Continuation-in-part of Ser. No. 858,151, May 1, 1986.

[51] Int. Cl.[4] ..... F01C 1/10; F01C 21/14; F03C 2/08

[52] U.S. Cl. ..... 418/57; 418/61 B; 418/133; 418/186

[58] Field of Search ..... 418/57, 61 B, 132, 133, 418/186–188

[56] References Cited

U.S. PATENT DOCUMENTS

| | | | |
|---|---|---|---|
| 3,233,524 | 2/1966 | Charlson | 418/61 B |
| 3,270,682 | 9/1966 | Charlson | 418/61 B |
| 3,490,383 | 1/1970 | Parrett | 418/61 B |
| 3,825,376 | 7/1974 | Petersen et al. | 418/61 B |
| 3,894,821 | 7/1975 | White, Jr. | 418/133 |
| 4,411,606 | 10/1983 | Miller | 418/61 B |
| 4,474,544 | 10/1984 | White, Jr. | 418/61 B |
| 4,480,971 | 11/1984 | Swedberg | 418/61 B |

*Primary Examiner*—John J. Vrablik

*Attorney, Agent, or Firm*—D. A. Rowe; L. J. Kasper

[57] ABSTRACT

A rotary fluid pressure device is disclosed of the type including a gerotor gear set including a ring member (19) and a star member (23). Both manifold valving and commutator valving are accomplished at an interface between an end surface (42) of the star (23) and an end surface (41) of an endcap member (17). The endcap (17) defines three concentric pressure chambers (43), (51) and (47), and the star defines three concentric manifold zones (63), (67), and (65) which are in continuous communication with the pressure chambers (43), (51) and (47), respectively. The various manifold zones (63), (67), and (65) defined by the star communicate with fluid ports (69), (77) and (73), respectively which are also defined by the end surface (b 42) of the star (23). A valve spool (97) is selectively operable between a first condition providing communication between the manifold zones (63) and (67) to achieve a low-speed, high-torque (LSHT) mode of operation, and a second condition providing communication between the manifold zones (67) and (65) to achieve a high-speed, low-torque (HSLT) mode of operation.

15 Claims, 9 Drawing Figures

TWO-SPEED VALVE-IN STAR MOTOR

CROSS-REFERENCE TO RELATED APPLICATION

This application is a continuation-in-part of corresponding application U.S. Ser. No. 858,151, filed May 1, 1986.

BACKGROUND OF THE DISCLOSURE

The present invention relates to rotary fluid pressure devices, and more particularly, to such devices which include gerotor displacement mechanisms utilizing low-speed, commutating valving.

In conventional gerotor motors utilizing low-speed, commutating valving (i.e., the rotary valve element rotates at the speed of rotation of the gerotor star rather than the orbiting speed of the star) the valving action has been accomplished by means of a rotary valve member and a stationary valve member, with both valve members being separate and distinct from the gerotor displacement mechanism. One disadvantage of the conventional gerotor motor valving arrangements has been the occurrence of "timing" errors, especially in motor designs in which the rotary valve element was driven by the motor output shaft or the dogbone shaft. When torque wind-up of the dogbone shaft occurs, the relative position of the gerotor star and the rotary valve deviates from the theoretical position, resulting in an error in the valve "timing", i.e., the communication of fluid into and out of the volume chambers as they expand and contract. Another disadvantage of arrangements in which the stationary and rotary valve elements are separate from the gerotor mechanism is simply the excessive number of parts required and the resulting expense.

It has been recognized for a number of years that one solution to the types of problems mentioned above is the provision of a gerotor motor in which a portion of the gerotor star itself comprises the rotary valve member ("valve-in-star"). It has been recognized that a valve-in-star design should substantially eliminate valve timing errors because of the fixed relationship between the star and the rotary valve ports. In addition, having fewer elements surrounded by leakage clearances and fewer elements requiring some sort of pressure balancing results in a motor capable of achieving both higher volumetric efficiency as well as higher mechanical efficiency. U.S. Pat. No. 3,825,376 illustrates one fairly early attempt at a valve-in-star design. However, each of the rotary ports associated with the gerotor star opened directly into the volume chamber, thus interrupting the star profile, which has long been recognized as being undesirable.

A more recent attempt to provide a satisfactory valve-in-star gerotor motor is illustrated in U.S. Pat. No. 4,411,606, in which the "manifold valving" or directional valving occurs between the star and the endcap, while the commutating valving occurs at the axially opposite end face of the star, at the interface of the star and an adjacent valve plate. Such an arrangement effectively requires that the valving be "fixed clearance", as opposed to being pressure balanced or pressure overbalanced. In addition, the arrangement in U.S. Pat. 4,411,606 requires a plurality of axial bores extending through the star to communicate between the opposite ends of the star. If such bores are fairly small, there is too much flow restriction, and too large a pressure drop within the motor, which reduces mechanical efficiency of the motor. On the other hand, if such bores are large enough to avoid excessive flow restriction, the result is a weakening of the star.

Accordingly, it is an object of the present invention to provide an improved low-speed, high-torque gerotor motor utilizing a valve-in-star design which substantially overcomes the problems of the prior art devices.

It is a further object of the present invention to provide a device in which both the manifold valving action and the commutating valving action occur at the interface of the gerotor star and the endcap disposed adjacent the star.

Low-speed, high-torque gerotor motors of the type to which this invention relates have typically been utilized in systems in which the relief valve would be set at approximately 3,500 psi, and in which the motor would operate at approximately 3,000 psi. More recently, there has been increasing demand in the marketplace for motors capable of operating at relatively higher pressures, at least intermittently, in systems in which the relief valve may be set as high as 4,500 psi or even 5,000 psi.

In the valve-in-star motor shown in above-cited U.S. Pat. No. 3,825,376, the variation in the number of volume chambers communicating with the ports, and the resulting torque ripple, make the motor shown therein unsuitable for high-pressure applications.

The motor shown in above-cited U.S. Pat. No. 4,411,606 is similarly unsuitable for high-pressure applications because of the "fixed clearance" type of valving which is inherent by virtue of valve action occurring between opposite end faces of the star and adjacent members fixed to the end surfaces of the gerotor ring. As is well known to those skilled in the art, subjecting a fixed clearance valve to relatively higher pressures would result in excessive "cross-port" leakage, and reduced volumetric efficiency.

Accordingly, it is another important object of the present invention to provide an improved low-speed, high-torque gerotor motor utilizing a valve-in-star design wherein the motor is capable of being used in relatively higher pressure applications.

It has also been an object of those skilled in the art to provide a simple, but efficient, two-speed gerotor motor. As used herein, the term "two-speed" means that for any given rate of fluid flow into the motor, it is possible to select between two different motor output speeds; a high-speed (low-torque), and the conventional low-speed (high-torque). U.S. Pat. No. 3,778,198 discloses the basic concept for achieving two-speed operation of a gerotor motor. The motor shown in the reference patent is of the spool valve type which has been limited to relatively lower pressures and torques, because of the fixed diametral clearance between the rotating spool valve and the adjacent cylindrical housing surface.

More recently, U.S. Pat. No. 4,480,971, assigned to the assignee of the present invention, teaches a two-speed gerotor motor of the disk valve type which, therefore, is more suited for applications requiring relatively higher pressures and torques. Although it is believed that the device shown in U.S. Pat. No. 4,480,971 will result in a commercially successful two-speed gerotor motor, the design disclosed therein is somewhat large and complex, and is subject to the pressure and torque limitations inherent in disk valve gerotor motors.

Accordingly, it is still another object of the present invention to provide an improved low-speed, high-torque gerotor motor utilizing a valve-in-star design which includes the ability for the motor to operate in either the low-speed, high-torque mode or the high-speed, low-torque mode.

SUMMARY OF THE INVENTION

The above and other objects of the present invention are accomplished by the provision of an improved rotary fluid pressure device of the general type set forth in U.S. Pat. No. 4,411,606 wherein the device comprises a housing means including an endcap member defining a fluid inlet port and a fluid outlet port; a gerotor gear set associated with said housing means and including an internally-toothed ring member and an externally-toothed star member eccentrically disposed within the ring member; either the ring member or the star member has orbital movement relative to the other of the members, and the star member has rotational movement relative to the ring member and the housing means; the internal teeth of the ring member and the external teeth of the star interengage to define a plurality N+1 of expanding and contracting fluid volume chambers during the relative orbital and rotational movements; the device includes a shaft means and means operable to transmit the rotational movement of the star member to the shaft means; the endcap member defines a first fluid pressure chamber in continuous communication with either the inlet or outlet port, and a second fluid pressure chamber in continuous communication with the other port; the star member defines a first manifold zone in continuous fluid communication with the first fluid pressure chamber, and a second manifold zone in continuous fluid communication with the second fluid pressure chamber; the star member includes an end surface disposed toward the endcap member and defining first and second sets of fluid ports, the first set of fluid ports being in continuous fluid communication with the first manifold zone, and the second set of fluid ports being in continuous fluid communication with the second manifold zone.

The improved device is characterized by: (a) the end surface of the star member is in sliding, sealing engagement with an adjacent surface of the endcap member; (b) the endcap member defines a third fluid pressure chamber and a control fluid passage in communication with the third fluid pressure chamber; (c) the star member defines a third manifold zone in continuous fluid communication with the third fluid pressure chamber; (d) the end surface of the star member defines a third set of fluid ports in continuous fluid communication with the third manifold zone; (e) the adjacent surface of the endcap member defines a plurality N+1 of valve passages, each of the valve passages being in continuous fluid communication with one of the expanding and contracting fluid volume chambers; (f) the first, second and third sets of fluid ports are in commutating fluid communication with the plurality N+1 of valve passages, defined by the endcap member, in response to the relative rotational movement of the star member; and (g) a valve means is selectively operable between a first condition communicating the control fluid passage to the first fluid pressure chamber, and a second condition communicating the control fluid passage to the second fluid pressure chamber.

DESCRIPTION OF THE PREFERRED EMBODIMENT

Figure 1:
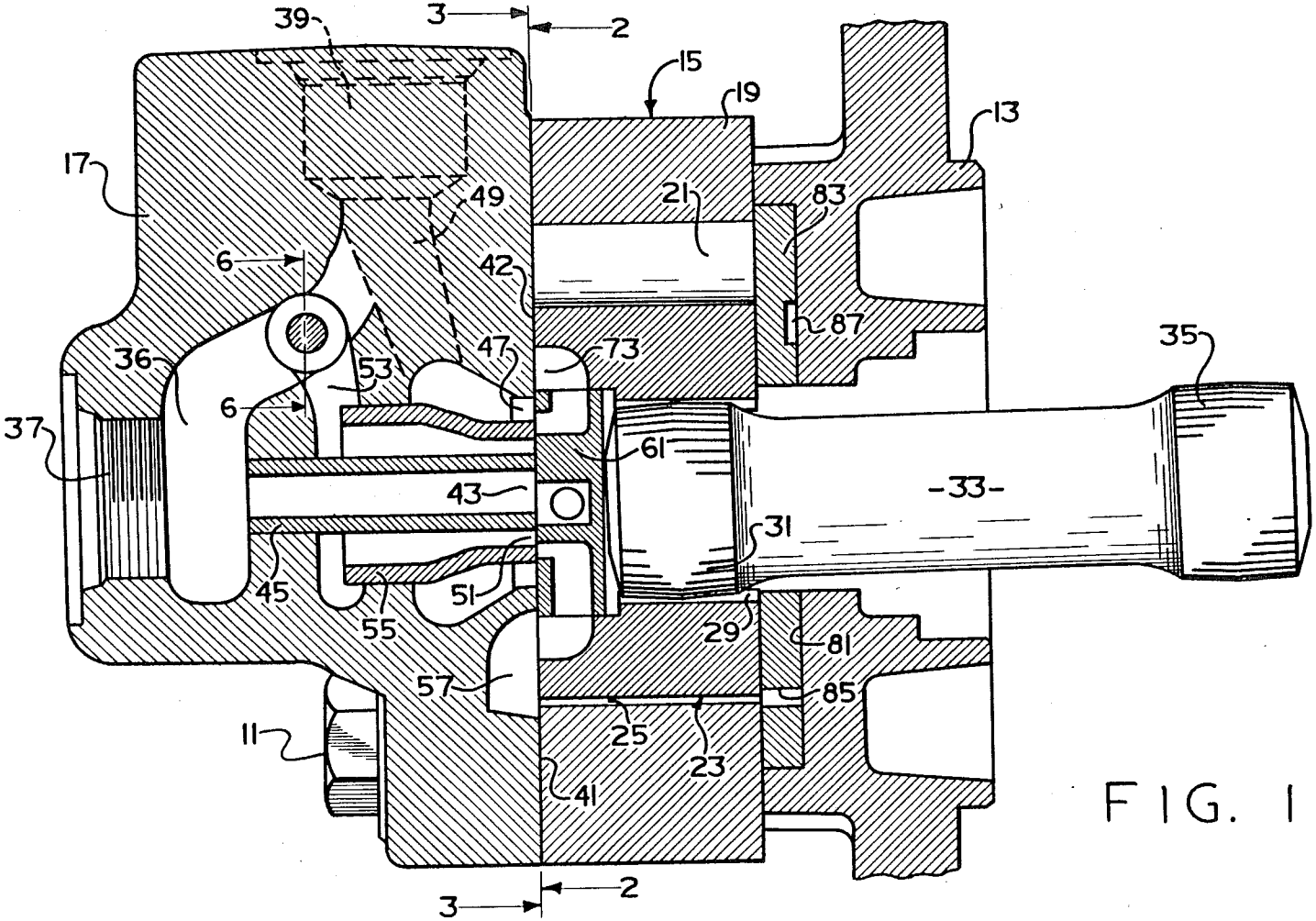
FIG. 1 is an axial cross-section of a normally low-speed, high-torque gerotor motor made in accordance with the present invention.

Referring now to the drawings, which are not intended to limit the invention, FIG. 1 illustrates a low-speed, high-torque gerotor motor. The hydraulic motor shown in FIG. 1 comprises a plurality of sections secured together, such as by a plurality of bolts 11. The sections of the motor include a shaft housing portion 13, a gerotor displacement mechanism 15, and an endcap member 17.

Figure 3:
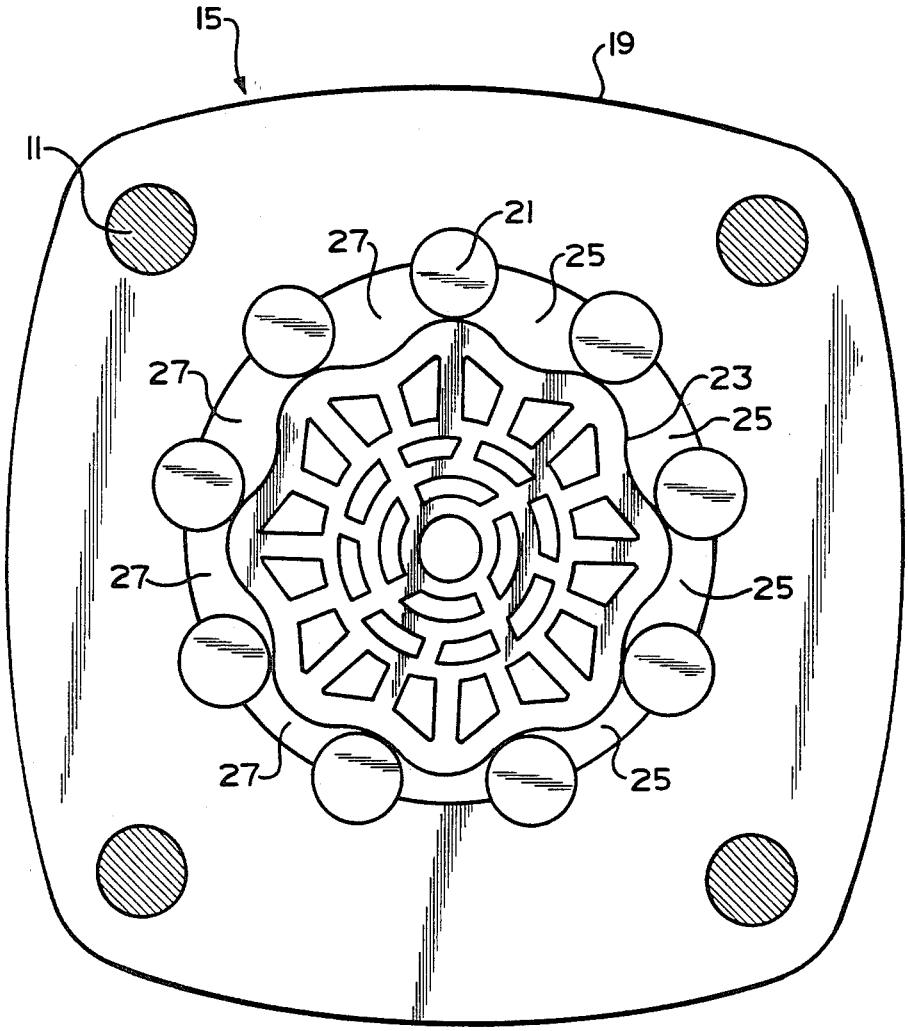
FIG. 3 is a transverse cross-section, showing the end surface of the gerotor gear set adjacent the endcap, taken on line 3—3 of FIG. 1, and on the same scale.

The gerotor displacement mechanism 15 (best seen in FIG. 3) is well known in the art, is shown and described in great detail in U.S. Pat. No. 4,343,600, which is assigned to the assignee of the present invention, is incorporated herein by reference, and therefore will be described only briefly herein. More specifically, the displacement mechanism 15 is a Geroler® gear set comprising an internally-toothed ring member 19 defining a plurality of generally semi-cylindrical openings, with a cylindrical roller member 21 disposed in each of the openings, and serving as the internal teeth of the ring member 19. Eccentrically disposed within the ring 19 is an externally-toothed star 23, typically having one less external tooth than the number of internal teeth 21, thus permitting the star 23 to orbit and rotate relative to the ring member 19. The relative orbital and rotational movement between the ring 19 and the star 23 defines a plurality of expanding fluid volume chambers 25 and a plurality of contracting fluid volume chambers 27, as is well known in the art.

Referring again primarily to FIG. 1, the star 23 defines a plurality of straight, internal splines 29, which are in engagement with a set of external crowned splines 31 formed on one end of a main drive shaft 33. Disposed at the opposite end of the main drive shaft 33 is another set of external, crowned splines 35, adapted to be in engagement with another set of straight, internal splines defined by some form of rotary output such as a shaft or wheel hub. As is well known to those skilled in the art, gerotor motors of the type to which the invention relates may include a rotary output shaft, supported by suitable bearings, such as is illustrated in U.S. Pat. No. 4,343,600, and it will be understood that the invention is not limited to any particular configuration of output shaft. It is essential only that the device include some form of shaft means operable to transmit the rotary motion of the star 23.

In the subject embodiment, because the ring member 19 includes nine internal teeth 21 and the star 23 includes eight external teeth, eight orbits of the star 23 result in one complete rotation thereof and one complete rotation of the output end of the main drive shaft 33 as is well known in the art.

Figure 2:
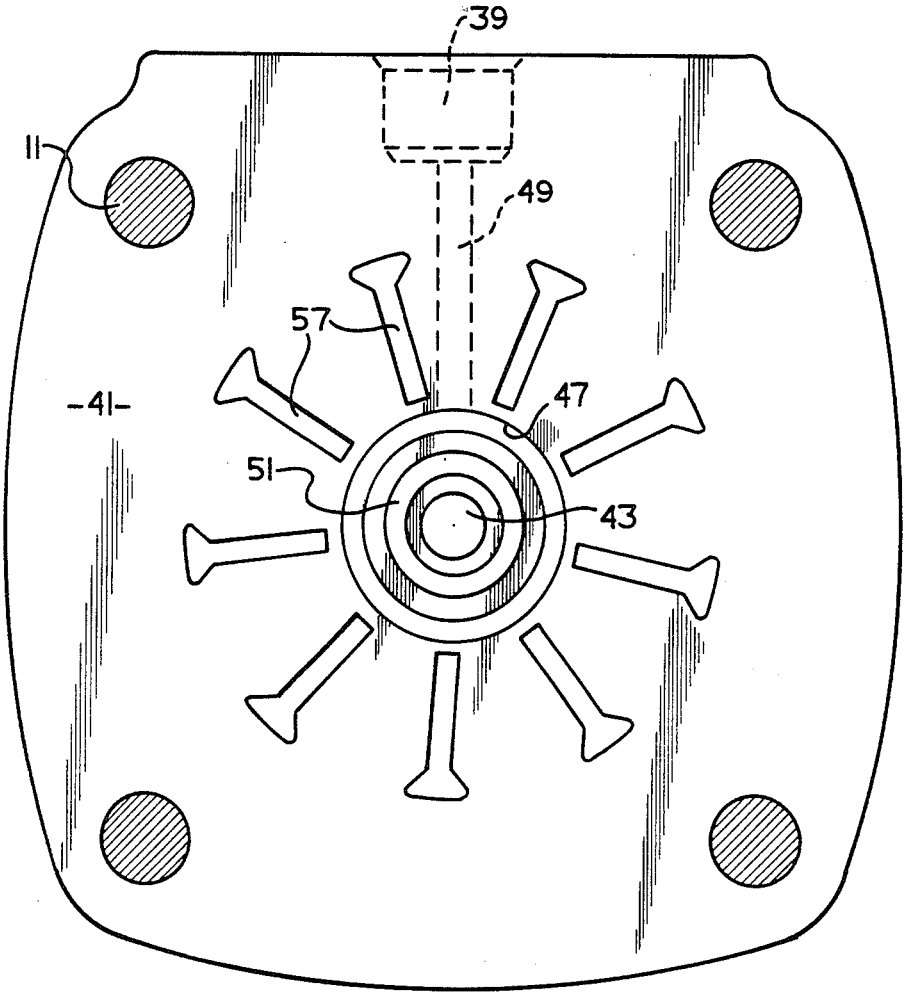
FIG. 2 is a transverse cross-section, showing the surface of the endcap member, taken on line 2—2 of FIG. 1, and on the same scale.

Referring now to FIG. 2, in conjunction with FIG. 1, the endcap member 17 includes a fluid inlet port 37 and a fluid outlet port 39. The endcap member 17 includes an end surface 41 in sliding sealing engagement with an end surface 42 (see FIG. 1) of the star 23 and disposed adjacent the gerotor gear set 15. The end surface 41 defines a fluid pressure chamber 43 which is in fluid communication with the fluid inlet port 37, through a fluid passage 36, by means of a tubular member 45 which is pressed into a circular opening defined by the endcap 17. The end surface 41 further defines an annular fluid pressure chamber 47 which is preferably disposed to be concentric with the fluid pressure chamber 43. The pressure chamber 47 is in fluid communication with the fluid outlet port 39 by means of a passage 49.

Disposed radially between the fluid pressure chambers 43 and 47 is an annular fluid pressure chamber 51, which is in fluid communication with a cored passage 53, defined by the endcap member 17, by means of a generally tubular member 55. The tubular member 55 is pressed into a circular opening in the endcap member 17 and serves to separate the annular fluid pressure chambers 47 and 51.

The end surface 41 of the endcap member 17 further defines a plurality of stationary valve passages 57, also referred to in the art as "timing slots". In the subject embodiment, each of the valve passages 57 would typically comprise a radially oriented, milled slot, each of which would be disposed in permanent, continuous fluid communication with an adjacent one of the volume chambers 25 or 27. Preferably, the valve passages 57 are disposed in a generally annular pattern which is concentric relative to the annular fluid pressure chambers 43, 47 and 51, as is illustrated in FIG. 2.

Figure 4:
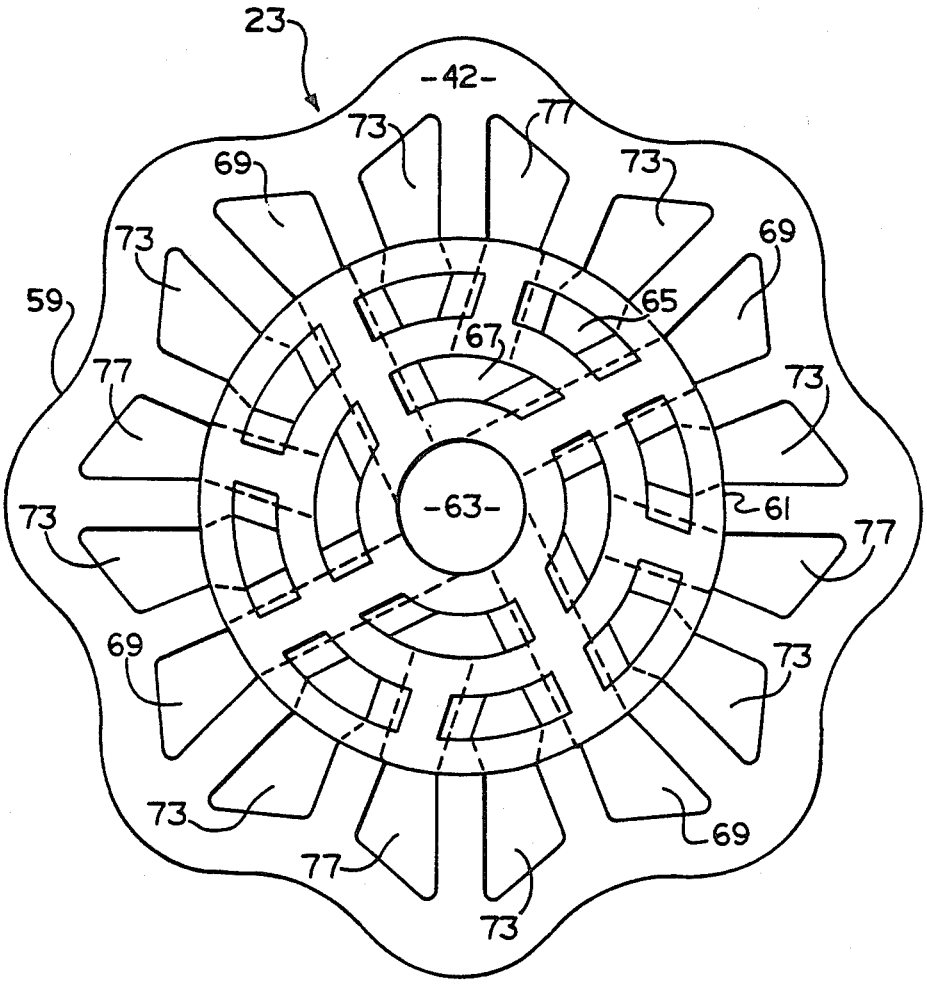
FIG. 4 is an enlarged plan view, similar to FIG. 3, showing a preferred embodiment of a gerotor star made in accordance with the present invention.

Referring now primarily to FIG. 4, in conjunction with FIG. 1, the externally-toothed star 23 will be described in greater detail. Although not an essential feature of the invention, it is preferable that the star 23 comprise an assembly of two separate parts. In the subject embodiment, the star 23 comprises two separate powdered metal parts, including a main portion 59, which includes the external teeth, and an insert or plug 61. The main portion 59 and the insert 61 cooperate to define the various fluid zones, passages and ports which will be described subsequently.

Figure 5C:
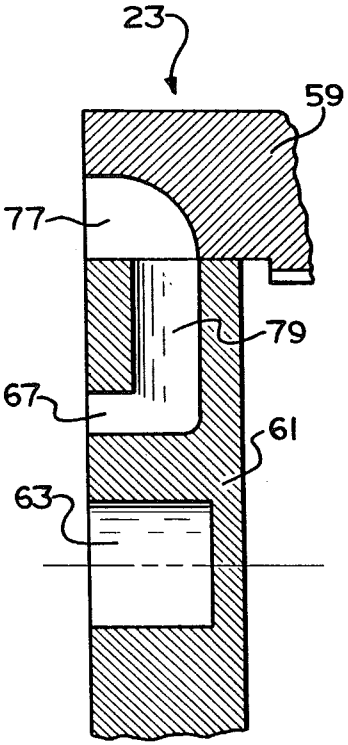
FIGS. 5A, 5B, and 5C are fragmentary, somewhat simplified cross-sections taken through the gerotor star of FIG. 4 at three different locations, and on the same scale as FIG. 4.
Figure 5B:
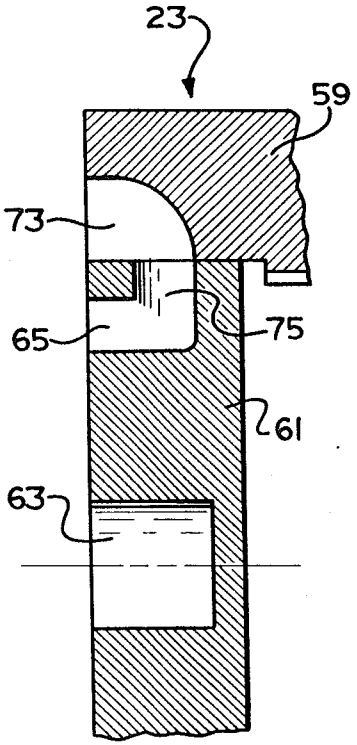

Referring now primarily to FIGS. 4 and 5, the star 23 defines a central manifold zone 63, which is in continuous fluid communication with the pressure chamber 43. Concentric with the manifold zone 63 is another outer manifold zone 65, which is in continuous fluid communication with the annular pressure chamber 47. Disposed radially between the manifold zones 63 and 65, and concentric therewith, is an intermediate manifold zone 67, which is in continuous fluid communication with the annular pressure chamber 51. As may best be seen in FIG. 4, the use of the term "zone" in regard to the manifold zones 63, 65 and 67 will be understood by those skilled in the art to mean and include either a single opening (as in the case of the manifold zone 63), or a plurality of separate, circumferentially spaced openings (as in the case of the manifold zones 65 and 67).

Figure 5A:
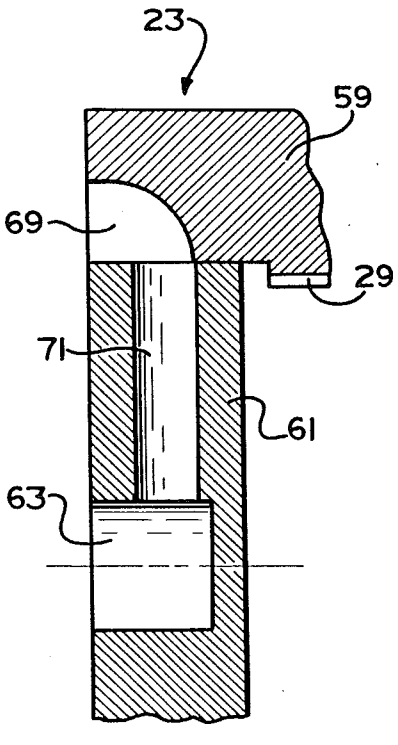

The end surface 42 of the star 23 defines a set of fluid ports 69, each of which is in fluid communication with the central manifold zone 63 by means of a fluid passage 71 (see FIG. 5A). In the subject embodiment, there are four of the ports 69 and fluid passages 71.

The end surface 42 of the star 23 further defines a set of fluid ports 73, each of which is in fluid communication with one of the openings of the outer manifold zone 65 by means of a fluid passage 75. In the subject embodiment, there are eight of the fluid ports 73 and of the fluid passages 75.

The end surface 42 of the star 23 also defines a set of fluid ports 77, each of which is in continuous fluid communication with one of the openings of the intermediate manifold zone 67 by means of a fluid passage 79. In the subject embodiment there are four of the fluid ports 77 and of the fluid passages 79.

As is well known to those skilled in the art, because there are nine of the internal teeth 21, there are nine of the valve passages 57. As the star 23 orbits and rotates relative to the ring member 19, the set of eight fluid ports 69 and 73 engage in a low speed, commutating valving action with respect to the valve passages 57. The result is that communication occurs only between the fluid ports 69 and 73 and the valve passages 57 which are instantaneously in fluid communication with one of the expanding volume chambers 25. At the same time, low-pressure exhaust fluid is communicated from the contracting volume chambers 27 through those valve passages 57 which are instantaneously in communication therewith, and this exhaust fluid then flows into certain of the fluid ports 77 which are instantaneously in communication with the particular valve passages 57 containing exhaust fluid.

Referring now primarily to FIG. 1 again, it may be seen that the shaft housing portion 13 defines a recess 81, and seated within the recess 81 is a pressure balancing plate 83. The balancing plate 83 defines a plurality of openings 85, each of which is in communication with one of the volume chambers 25 of 27. Each of the openings 85 communicates with a pressure-balancing recess 87 which is disposed on the side of the plate 83 opposite the gerotor gear set 15. Items 81 through 87 have been recited herein primarily for the purpose of completeness. Because pressure balancing is generally well known in the art of gerotor motors and forms no essential part of the present invention, there will be no further detailed description of the pressure-balancing plate 83 or of the size or shape of the recesses 87. It will be understood by those skilled in the art that the pressure balancing plate 83 may be used either to "balance" the star 23 in the axial direction, such that the hydraulic forces acting on the star 23 in opposite directions are approximately the same, or alternatively, the pressure-balancing plate 83 may be used to "overbalance" the star 23 into tight sealing engagement with the end surface 41 of the endcap member 17.

Figure 6:
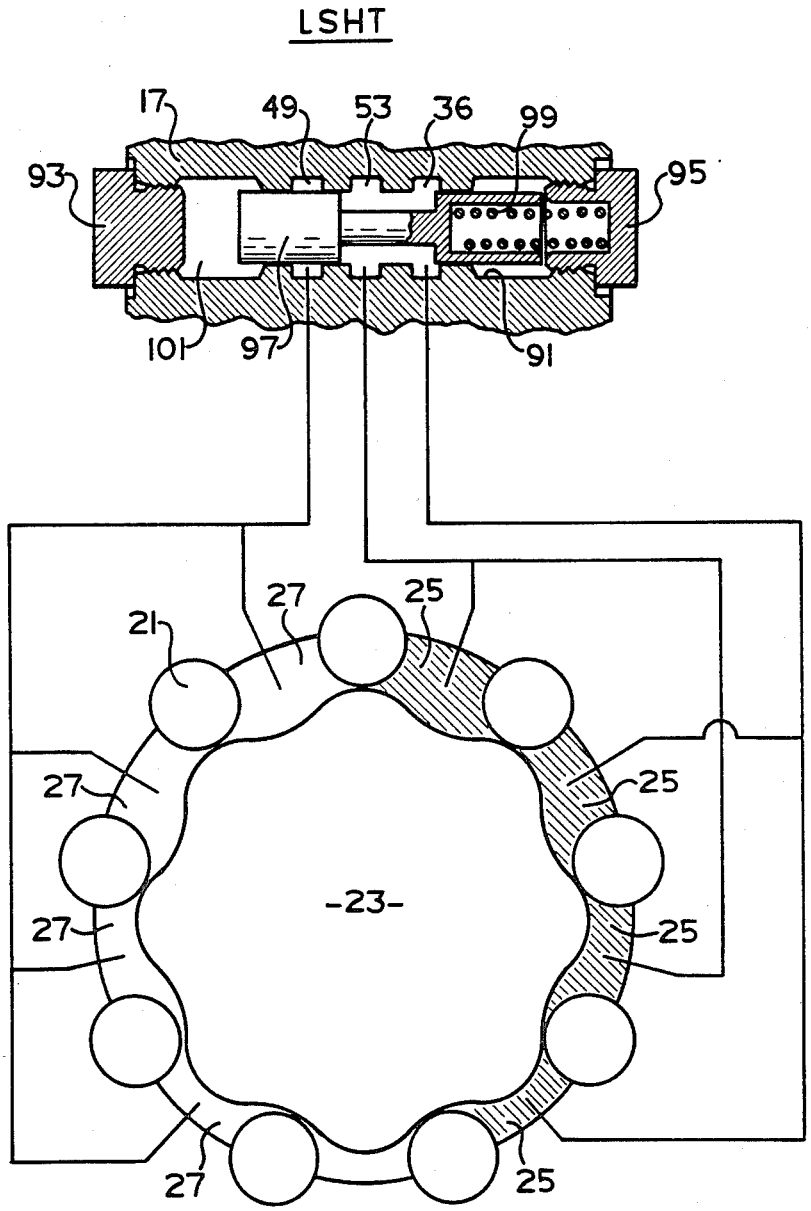
FIGS. 6 and 7 are views partly in schematic, and partly in transverse cross-section on line 6—6 of FIG. 1, illustrating the operation of the hydraulic circuit associated with the present invention.

Reference will now be made primarily to FIG. 6 which is a view partly in cross-section (on line 6—6 of FIG. 1) and partly in schematic. The endcap member 17 defines a spool bore 91 which is intersected by the fluid passages 36, 49, and 53, at locations axially spaced apart as shown in FIG. 6. The axially opposite ends of the spool bore 91 are closed by a pair of threaded fittings 93 and 95, and disposed within the spool bore 91 is a valve spool 97. The valve spool 97 is biased toward the left in FIG. 6 by a spring member 99, and is biased toward the right, to the position shown in FIG. 6 by fluid pressure in pressure chamber 101. The fluid pressure needed to bias the valve spool 97 to the position shown in FIG. 6 may be communicated to the pressure chamber 101 in any one of several ways well known to those skilled in the art, and which form no part of the present invention.

With the valve spool 97 biased to the position shown in FIG. 6, and assuming that the inlet port 37 is communicated to a source of high-pressure fluid, there will be high pressure in both of the fluid passage 36 and 53, as well as in the pressure chambers 43 and 51. As a result, as the star 23 orbits and rotates, high pressure will be communicated from the pressure chamber 43 into the central manifold zone 63, and from the pressure chamber 51 into the intermediate manifold zone 67. Therefore, high-pressure fluid will be present in all of the fluid ports 69 and fluid ports 77, from where high pressure will be communicated through the respective fluid passages 57 into the expanding volume chambers 25 (shading indicates high pressure fluid), causing the star 23 to orbit in a clockwise direction, while rotating in a counterclockwise direction, as viewed in FIG. 6. At the same time, low-pressure fluid is communicated from the contracting volume chambers 27 through the respective fluid passages 57 into certain of the fluid ports 73. Exhaust fluid from the ports 73 is communicated through the outer manifold zone 65 to the pressure chamber 47, and from there through the fluid passage 49 to the outlet port 39. Therefore, with the valve spool 97 in the position shown in FIG. 6, high pressure fluid is communicated to all four of the expanding volume chambers 25, while exhaust fluid is communicated from all four of the contracting volume chambers 27, and the gerotor motor operates in a normal low-speed, high-torque (LSHT) mode.

Figure 7:
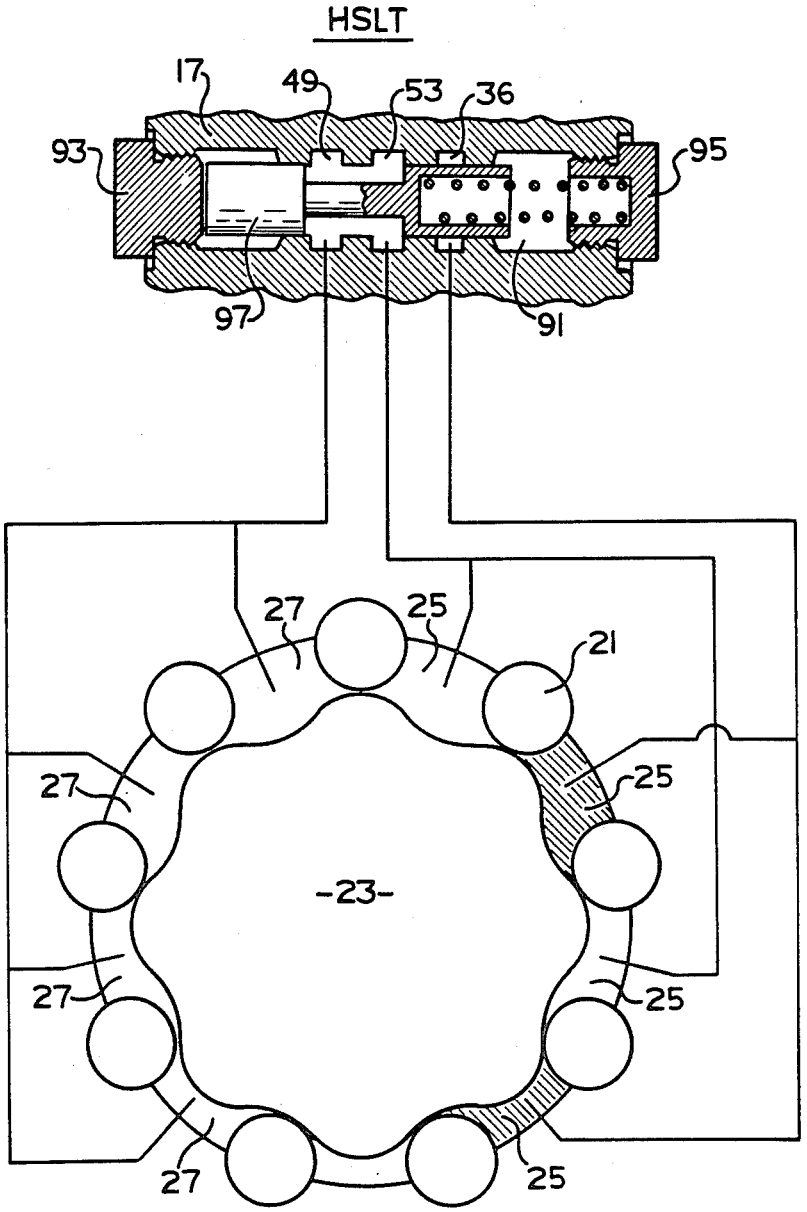

Referring now to FIG. 7, the device of the present invention will be described in connection with operation in the high-speed, low-torque (HSLT) mode. In order to select the HSLT mode, it is necessary to reduce the fluid pressure in the pressure chamber 101 sufficiently to permit the spring member 99 to bias the valve spool 97 to the position shown in FIG. 7 in which the fluid passages 49 and 53 are in relatively unrestricted communication, and both are blocked from fluid communication with the fluid passage 36. In this mode of operation, with high-pressure communicated to the inlet port 37, there will be high pressure in only pressure chamber 43, while both of the pressure chambers 51 and 47 are in communication with low-pressure fluid, by means of the fluid passages 53 and 49, respectively.

In the HSLT mode, high-pressure fluid is communicated from the pressure chamber 43 through the central manifold zone 63 into the fluid ports 69. As may be seen in FIG. 7, this results in communication of high-pressure fluid into only two of the expanding volume chambers 25. At the same time, exhaust fluid from the contracting volume chambers 27 is communicated through the associated fluid ports 73, outer manifold zone 65, and pressure chamber 47 as described in connection with FIG. 6. However, because the fluid passages 49 and 53 are in open communication, a portion of the low-pressure exhaust fluid from the contracting volume chambers 27 is communicated through the fluid passage 53 and into the pressure chamber 51, and from there into the intermediate manifold zone 67 and through the fluid ports 77 into the other two of the expanding volume chambers 25. In other words, with the same volume of high-pressure fluid commuicated to the inlet port 37 as in the LSHT mode will now, in the HSLT mode, be communicated to only half of the expanding volume chambers 25, thus resulting in orbital and rotational movement of the star 23 at twice the speed, but with only half as much torque.

Although the present invention has been described in connection with an embodiment wherein the star 23 rotates at twice the speed, but only half the torque in the HSLT mode, it should be clear to those skilled in the art that the invention is not so limited. The number of ports and passages, etc., can be varied from that shown herein to achieve speed ratios other than 2:1. The invention has been described in great detail sufficient to enable one skilled in the art to make and use the same. It is apparent that various alterations and modifications will occur to those skilled in the art, and it is intended to include all such alterations and modifications as part of the invention, insofar as they come within the scope of the appended claims.

I claim:

1. A rotary fluid pressure device of the type comprising housing means including an endcap member defining a fluid inlet port and a fluid outlet port; a gerotor gear set associated with said housing means and including an internally-toothed ring member, and an externally-toothed star member eccentrically disposed within said ring member: one of said ring member and said star member having orbital movement relative to the other of said members, and said star member having rotational movement relative to said ring member and said housing means; the internal teeth of said ring member and the external teeth of said star member interengaging to define a plurality N+1 of expanding and contracting fluid volume chambers during said relative orbital and rotational movements; shaft means and means operable to transmit said rotational movement of said star member to said shaft means: said endcap member defining a first fluid pressure chamber in continuous fluid communication with said one of said fluid inlet port and said fluid outlet port, and a second fluid pressure chamber in continuous fluid communication with the other of said fluid inlet port and said fluid outlet port; said star member defining a first manifold zone in continuous fluid communication with said first fluid pressure chamber, and a second manifold zone in continuous fluid communication with said second fluid pressure chamber; said star member including an end surface disposed toward said endcap member and defining first and second sets of fluid ports, said first set of fluid ports being in continuous fluid communication with said first manifold zone, and said second set of fluid ports being in continuous fluid communication with said second manifold zone, characterized by:

(a) said end surface of said star member being in sliding, sealing engagement with an adjacent surface of said endcap member;

(b) said endcap member defining a third fluid pressure chamber and a control fluid passage in communication with said third fluid pressure chamber;

(c) said star member defining a third manifold zone in continuous fluid communication with said third fluid pressure chamber:

(d) said end surface of said star member defining a third set of fluid ports in continuous fluid communication with said third manifold zone;

(e) said adjacent surface of said endcap member defining a plurality N+1 of valve passages, each of said valve passages being in continuous fluid communication with one of said expanding and contracting fluid volume chambers;

(f) said first, second, and third sets of fluid ports being in commutating fluid communication with said plurality N+1 of valve passages, defined by said endcap member, in response to said relative rotational movement of said star member; and (g) valve means selectively operable between a first condition communicating said control fluid passage to said first fluid pressure chamber, and a second condition communicating said control fluid passage to said second fluid pressure chamber.

2. A rotary fluid pressure device as claimed in claim 1 characterized by said second fluid pressure chamber surrounding said first fluid pressure chamber, and said third fluid pressure chamber being disposed radially between said first and second fluid pressure chambers.

3. A rotary fluid pressure device as claimed in claim 2 characterized by said third manifold zone being disposed radially between said first and second manifold zones.

4. A rotary fluid pressure device as claimed in claim 1 characterized by said first, second, and third fluid pressure chambers being generally annular, said third fluid pressure chamber surrounding said first fluid pressure chamber, and said second fluid pressure chamber surrounding said third fluid pressure chamber.

5. A rotary fluid pressure device as claimed in claim 4 characterized by said first, second, and third manifold zones being generally annular, said third manifold zone surrounding said first manifold zone, and said second manifold zone surrounding said third manifold zone.

6. A rotary fluid pressure device as claimed in claim 1 characterized by said first, second, and third sets of fluid ports being defined solely by said end surface of said star member.

7. A rotary fluid pressure device as claimed in claim 1 characterized by said first, second, and third sets of fluid ports being in fluid communication with said first, second, and third manifold zones, respectively, by means of first, second, and third fluid passage means, respectively.

8. A rotary fluid pressure device as claimed in claim 7 characterized by said first and third fluid passage means being disposed entirely within said star member.

9. A rotary fluid pressure device as claimed in claim 8 characterized by said second fluid passage means being disposed entirely within said star member.

10. A rotary fluid pressure device as claimed in claim 1 characterized by said plurality N+1 of valve passages defined by said adjacent surface of said endcap being disposed in a generally annular pattern which is generally concentric about said second fluid pressure chamber.

11. A rotary fluid pressure device as claimed in claim 1 characterized by said first and third sets of fluid ports defined by said end surface of said star member comprising a plurality N of fluid ports.

12. A rotary fluid pressure device as claimed in claim 1 characterized by said first and third sets of fluid ports. and said second set of fluid ports together comprising a plurality 2N of fluid ports.

13. A rotary fluid pressure device as claimed in claim 1 characterized by said star member including an axially opposite second end surface, said housing means and said second end surface cooperating to define pressure-balancing means, to effect axial pressure balancing of said star member.

14. A rotary fluid pressure device as claimed in claim 13 characterized by said pressure balancing means being operable to effect a pressure overbalance of said star member axially toward said endcap member.

15. A rotary fluid pressure device as claimed in claim 1 characterized by said first condition of said valve means corresponding to a low-speed, high-torque mode of operation of said device, and said second condition of said valve means corresponding to a high-speed, low-torque mode of operation of said device.

* * * * *

UNITED STATES PATENT AND TRADEMARK OFFICE

CERTIFICATE OF CORRECTION

PATENT NO. : 4,715,798

DATED : December 29, 1987

INVENTOR(S) : Marvin L. Bernstrom

It is certified that error appears in the above-identified patent and that said Letters Patent are hereby corrected as shown below:

First page, filed date of patent should be changed from Jan. 28, 1986" to --Jan. 28, 1987--.

Signed and Sealed this

Second Day of August, 1988

*Attest:*

DONALD J. QUIGG

*Attesting Officer*

*Commissioner of Patents and Trademarks*